US007310875B2

(12) United States Patent
Evans

(10) Patent No.: US 7,310,875 B2
(45) Date of Patent: Dec. 25, 2007

(54) CONNECTOR FOR HIGH-SPEED COMMUNICATIONS

(75) Inventor: Robert F. Evans, Bedford, NH (US)

(73) Assignee: FCI Americas Technology, Inc., Reno, NV (US)

( * ) Notice: Subject to any disclaimer, the term of this patent is extended or adjusted under 35 U.S.C. 154(b) by 74 days.

(21) Appl. No.: 11/028,359

(22) Filed: Jan. 3, 2005

(65) Prior Publication Data

US 2005/0118869 A1 Jun. 2, 2005

Related U.S. Application Data

(62) Division of application No. 10/010,149, filed on Nov. 12, 2001, now Pat. No. 6,848,944.

(51) Int. Cl.
*H01R 43/00* (2006.01)

(52) U.S. Cl. ..... 29/884; 29/842; 29/845; 439/101; 439/108

(58) Field of Classification Search ..... 29/825, 29/826, 847, 884, 842, 845; 439/101, 108
See application file for complete search history.

(56) References Cited

U.S. PATENT DOCUMENTS

| | | | | | |
|---|---|---|---|---|---|
| 3,147,054 | A * | 9/1964 | Alexander et al. | 439/67 |
| 3,158,421 | A * | 11/1964 | Hasenauer, Jr. | 439/493 |
| 4,241,970 | A * | 12/1980 | Rider et al. | 439/403 |
| 4,357,750 | A * | 11/1982 | Ostman | 29/847 |
| 4,571,014 | A | 2/1986 | Robin et al. | 439/108 |
| 4,762,500 | A * | 8/1988 | Dola et al. | 439/79 |
| 5,088,009 | A * | 2/1992 | Harada et al. | 361/787 |
| 5,161,987 | A | 11/1992 | Sinisi | 439/101 |
| 5,190,462 | A | 3/1993 | Lauchner et al. | 436/65 |
| 5,343,616 | A * | 9/1994 | Roberts | 29/846 |
| 5,507,655 | A * | 4/1996 | Goerlich | 439/108 |
| 5,526,565 | A * | 6/1996 | Roberts | 29/884 |
| 5,766,023 | A | 6/1998 | Noschese et al. | 439/74 |
| 6,083,047 | A | 7/2000 | Paagman | 439/608 |
| 6,129,555 | A | 10/2000 | Daikuhara et al. | 439/607 |
| 6,171,115 | B1 | 1/2001 | Mickievicz et al. | 439/76.1 |
| 6,267,604 | B1 | 7/2001 | Mickievicz et al. | 439/79 |
| 6,293,827 | B1 * | 9/2001 | Stokoe | 439/608 |
| 6,350,134 | B1 * | 2/2002 | Fogg et al. | 439/79 |
| 6,461,202 | B2 | 10/2002 | Kline | 439/701 |
| 6,565,387 | B2 * | 5/2003 | Cohen | 439/608 |

FOREIGN PATENT DOCUMENTS

| | | |
|---|---|---|
| EP | 1 017 134 A2 | 7/2000 |
| EP | 0 752 739 B1 | 10/2000 |
| EP | 1 139 498 A2 | 10/2001 |
| EP | 0 854 549 B1 | 6/2004 |
| WO | WO99/19943 | 4/1999 |
| WO | WO 01/39332 A1 | 5/2001 |

* cited by examiner

*Primary Examiner*—Carl J. Arbes
(74) *Attorney, Agent, or Firm*—Woodcock Washburn LLP

(57) ABSTRACT

A high speed electrical connector is provided that comprises a substantially planar dielectric, a substantially planar ground plane, and a signal conductor. The ground plane is disposed on one planar surface of the planar dielectric and the signal conductor is disposed on the opposing planar surface of the planar dielectric.

11 Claims, 7 Drawing Sheets

CONNECTOR FOR HIGH-SPEED COMMUNICATIONS

CROSS-REFERENCE TO RELATED APPLICATIONS

This application is a divisional application and claims priority under 35 U.S.C. §120 and §121 to U.S. patent application Ser. No. 10/010,149 filed Nov. 12, 2001, now U.S. Pat. No. 6,848,944 which is herein incorporated by reference in its entirety.

FIELD OF THE INVENTION

The invention relates in general to electrical connectors. More particularly, the invention relates to electrical connectors for high speed communications.

BACKGROUND OF THE INVENTION

Electrical connectors provide signal connections between electronic devices. Often, the signal connections are so closely spaced that undesirable cross talk occurs between nearby signals. That is, one signal induces electrical interference to a nearby signal. With electronic device miniaturization and high speed electronic communications becoming more prevalent, cross talk becomes a significant factor in connector design. In order to reduce cross talk between signals, it is known to provide grounding connection pins in such connectors. However, as communication speeds increase, wider signal conductors are typically used. With such wider signal conductors and conventional grounding, it becomes difficult to provide both high signal contact pin density and acceptable cross talk levels.

Therefore, a need exists for electrical connectors for high speed communications having a high density of signal contact pins and acceptable cross talk levels.

SUMMARY OF THE INVENTION

The invention is directed to a high speed electrical connector.

An electrical connector is provided that comprises a substantially planar dielectric, a substantially planar ground plane, and a signal conductor. The ground plane is disposed on one planar surface of the dielectric and the signal conductor is disposed on the opposing planar surface of the dielectric.

The dielectric may comprise polyimide, a recess for receiving a solder ball for a ball grid array connection to a circuit card, and a finger extending substantially in the plane of the dielectric. Moreover, the signal conductor may extend along the finger.

The ground plane may comprise a plurality of ground contact pins extending from an end of the ground plane and the ground plane comprises phosphor bronze and may be plated and etched onto the dielectric.

The signal conductor may comprise a signal contact pin, may be plated and etched onto the dielectric, and may comprise a differential pair of signal conductors.

The electrical connector may comprise a plurality of connection modules wherein each module comprises a substantially planar dielectric, a substantially planar ground plane, and a signal conductor.

An electrical interconnection system is also provided. The electrical interconnection system comprises a header connector and a receptacle connector. The header connector comprises a plurality of connection modules. Each module comprises a substantially planar dielectric, a substantially planar ground plane, and a signal conductor. The ground plane is disposed on one planar surface of the dielectric and the signal conductor is disposed on the other planar surface of the dielectric. The receptacle comprises a plurality of receptacle contacts for receiving the signal contact pins and the ground contact pins.

The foregoing and other features of the invention will become apparent from the following detailed description of the invention when considered in conjunction with the accompanying drawings.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF ILLUSTRATIVE EMBODIMENTS

Figure 1:
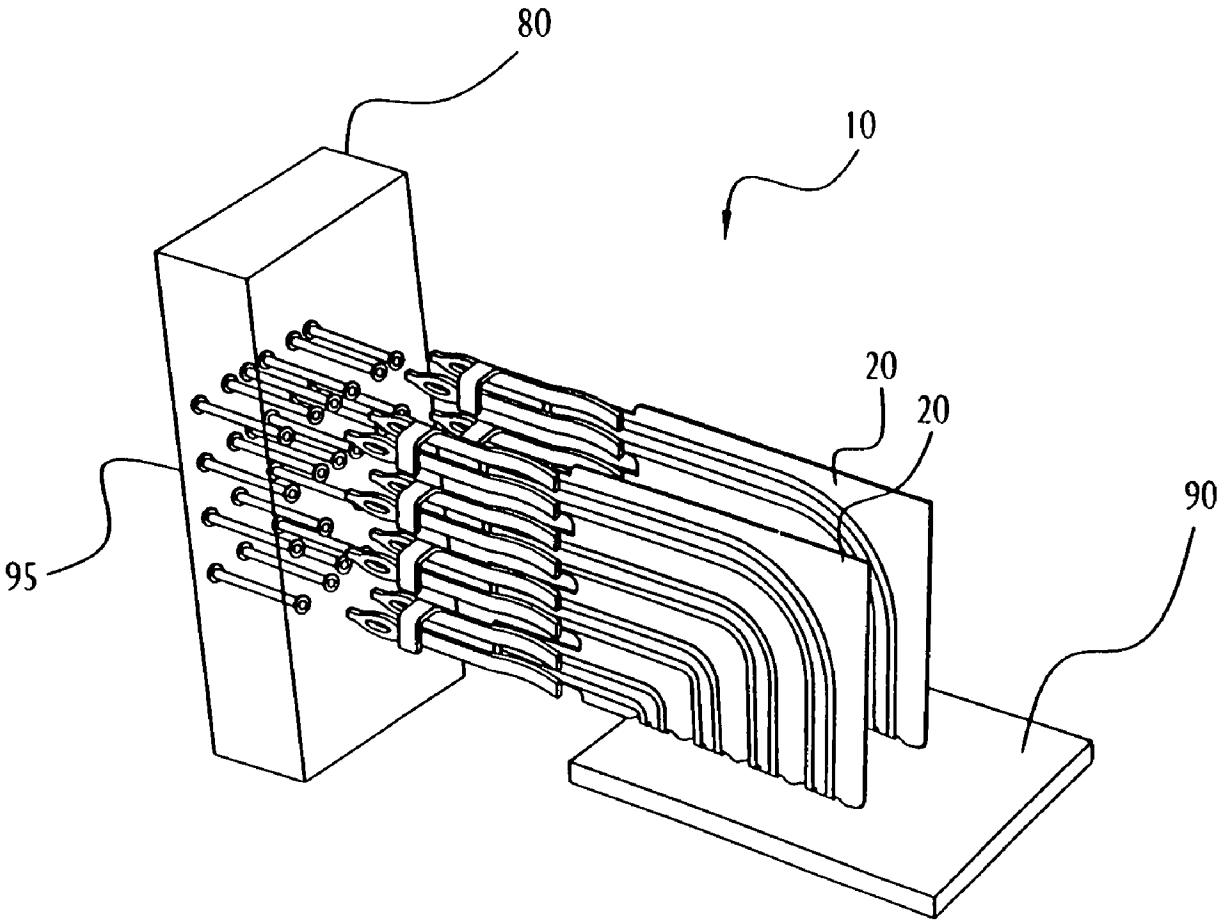
FIG. 1 is a perspective view of an illustrative electrical connector (without a housing) and illustrative receptacle, in accordance with an embodiment of the invention.

The invention is directed to a high speed electrical connector comprising a substantially planar dielectric, a substantially planar ground plane, and signal conductor. The ground plane is disposed on one planar surface of the dielectric and the signal conductor is disposed on the other planar surface of the dielectric.

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

FIG. 1 is a perspective view of an illustrative electrical connector (without a housing) and illustrative receptacle, in accordance with an embodiment of the invention. As shown in FIG. 1, connector 10 and receptacle 80 provide electrical connection between circuit board 90 and backplane 95. Connector 10 comprises a plurality of connection modules 20. Modules 20 may be contained in a housing (not shown) which may comprise molded thermoplastic or the like.

Each module 20 provides for electrical transmission of signals between circuit board 90 and backplane 95. As more signals are desired to be transmitted, more modules 20 may be added to connector 10. The number of signals depends in part on the type of data transmission.

One technique for transmitting data is common mode transmission, which is also referred to as single ended transmission. Common mode refers to a transmission mode which transmits a signal level that is compared to a reference voltage level, typically ground, that is common to other signals in the connector or transmission line. A limitation of common mode signaling is that common mode noise is often transmitted along with the signal.

Another technique of transmitting data is differential mode transmission. Differential mode refers to a transmission mode where a signal on one line of voltage V is referenced to a line carrying a complementary voltage of −V. Appropriate circuitry subtracts the lines, resulting in an output of V−(−V) or 2V. Common mode noise is canceled at the differential receiver by the subtraction of the signals. This technique reduces transmission errors, thereby increasing possible communication speed; however, more signal conductors are used for differential mode transmission than for common mode transmission. That is, for differential mode transmission, two conductors are used for each signal—a positive signal conductor and negative signal conductor. In contrast, for common mode transmission, many signals may share a single conductor as their ground conductor. Therefore, selection of the method of transmission depends on the application. As shown and described, connector 10 employs differential mode transmission; however, connector 10 may also employ single ended transmission.

Figure 2:
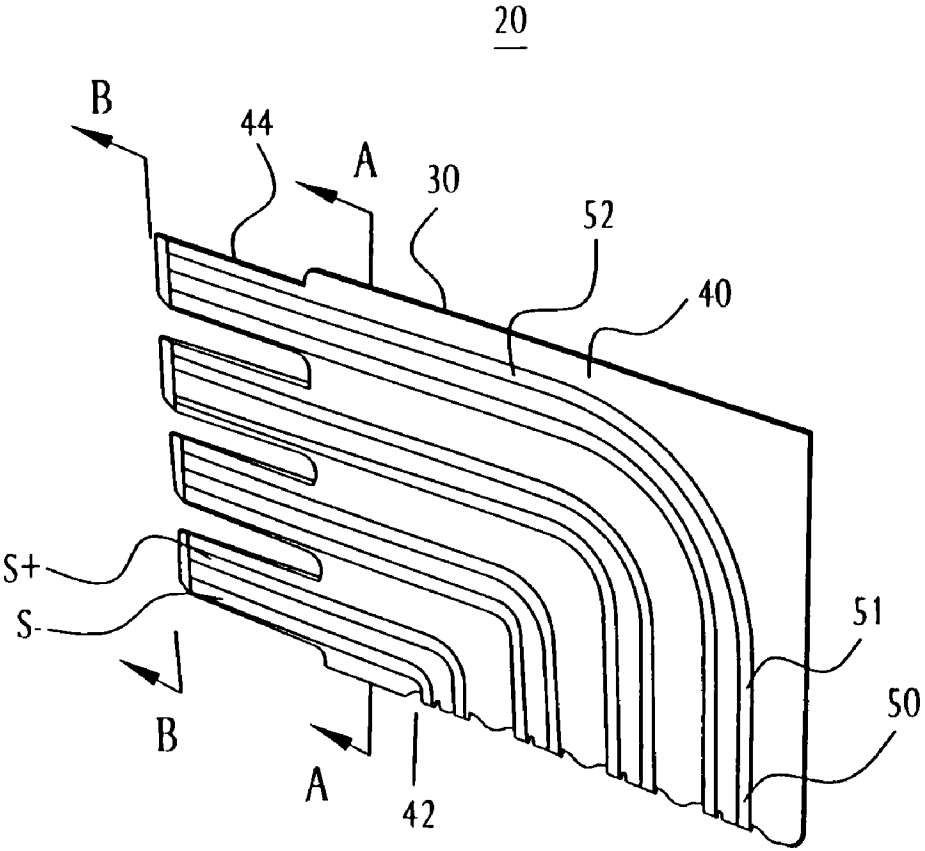
FIG. 2 is a perspective view of a portion of the electrical connector of FIG. 1.

FIG. 2 is a perspective view of a portion of module 20. As shown in FIG. 2, module 20 comprises a ground plane 30, a dielectric 40, and a plurality of signal conductors 50.

As can be seen, conductors 50 are disposed on a planar surface of dielectric 40 and are employed as signal conductors of a differential pair. That is, one conductor 50 is employed as a positive signal conductor S+ and an adjacent conductor 50 is employed as a negative signal conductor S−. Conductors within a differential pair of signal conductors are located closer than conductors of two adjacent differential pairs. In this manner, cross talk between differential pairs may be reduced.

Further, conductors 50 are located such that connector 10 is a right angle connector; however, connector 10 may be a straight through connector. As a right angle connector, signal conductor 50 comprises a first section 51 and a second section 52 disposed approximately ninety degrees to first section 51. In this manner, connector 10 may be used to connect between electronic devices having mating surfaces orthogonal to each other.

An illustrative conductor 50 has a width of approximately 0.38 mm, a thickness of approximately 0.08 mm, and a pitch of approximately 1 mm; however, various conductor dimensions may be used.

Conductors 50 may be plated and etched onto dielectric 40. Plating and etching conductors 50 onto dielectric 40 may simplify manufacturing by reducing assembly time and eliminating over-molding time. Also, etching conductors 50, rather than stamping conductors 50 from a die, provides the capability to more easily change conductor impedances i.e., by changing conductor size and/or spacing. That is, to manufacture a different size and/or spaced conductor, a stamped conductor may use a newly machined die. Such die machining may take an unacceptable long time. Moreover, plating and etching conductors 50 onto dielectric 40 may provide precisely spaced and sized conductors, thereby allowing more control of electrical transmission characteristics and therefore, higher speed communications.

Dielectric 40 is substantially planar and may comprise polyimide or the like. A low dielectric material is typically desired for high speed communications. Therefore, dielectric 40 may comprise polyimide; however, other materials may be used, typically, other low dielectric materials. An illustrative dielectric 40 is approximately 0.25 mm thick; however, various thicknesses may be employed depending on the desired impedance characteristics between conductors 50 and ground plane 30. Dielectric 40 comprises a recess 42 at an end of its planar surface proximate to conductor 50 for receiving a solder ball for a ball grid array attachment, for example, of conductor 50 to circuit board 90. While solder ball connection of conductor 50 to circuit board 90 is illustrated, other techniques are contemplated.

Dielectric 40 comprises a finger 44, extending substantially in the plane of the dielectric, for each differential pair of signal conductors. Conductors 50 of a differential pair of signal conductors extend along finger 44. Finger 44 is for attachment of a signal contact 52 (FIG. 4) to conductor 50.

Figure 4:
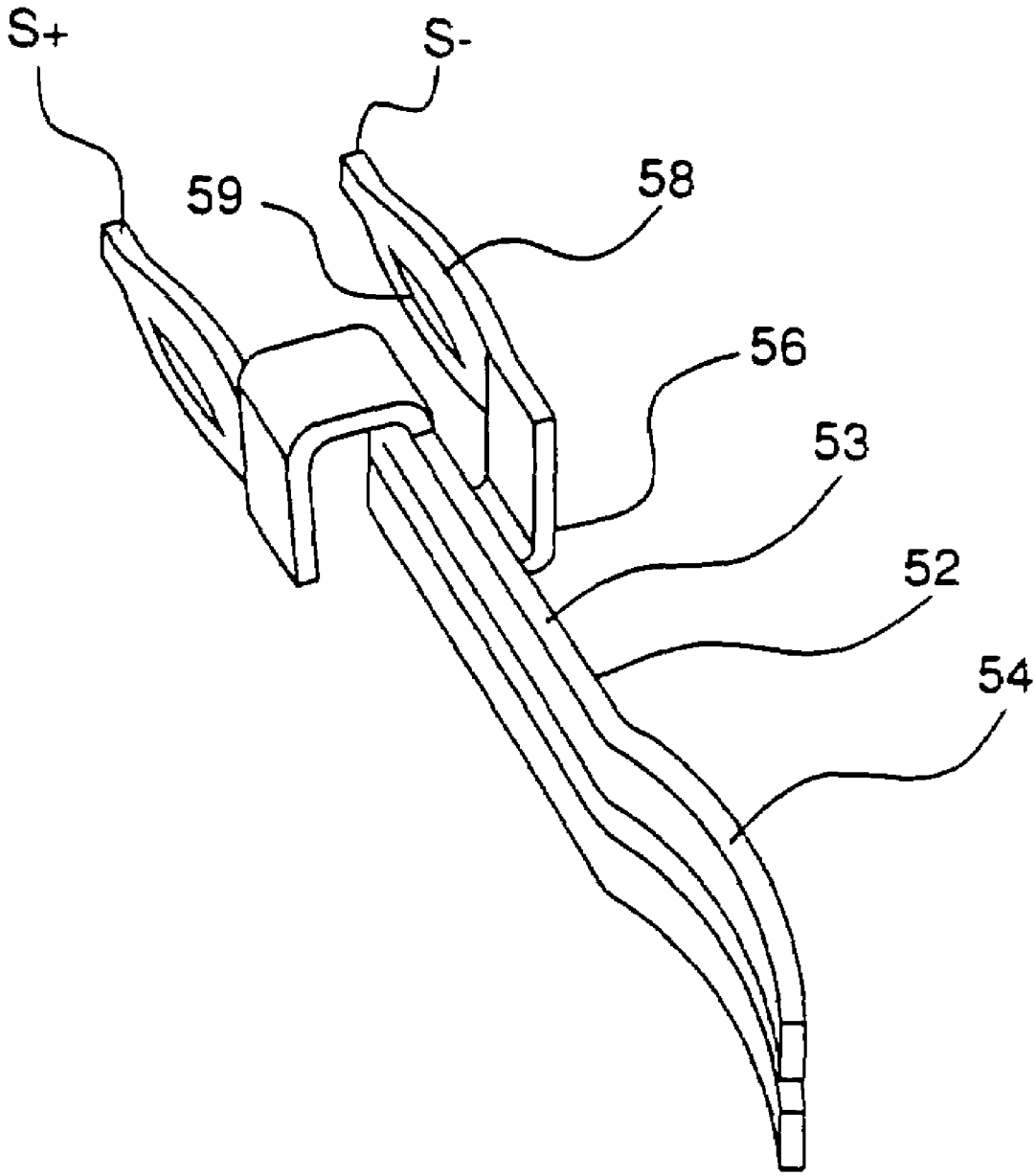
FIG. 4 is a perspective view of an illustrative pair of signal contact pins of the electrical connector of FIG. 1.

FIG. 4 is a perspective view of a pair of signal contacts 52. As shown in FIG. 4, each signal contact 52 comprises a straight section 53, bowed section 54, an offset section 56, and a signal contact pin 58. Straight section 53 comprises a substantially straight conductor. Bowed section 54 comprises a bowed conductor for connection between straight section 53 and conductor 50. Offset section 56 comprises a substantially planar surface bent at approximately a right angle to offset signal contact pin 58 from the plane of straight section 53 for connection to receptacle 80. Contact pin 58 is shown with an aperture 59 for providing good contact with receptacle 80; however, contact pin 58 may be any suitable contact pin. Further, signal contact 52 may be any suitable contact. Signal contacts 52 may comprise phosphor bronze, beryllium copper, and the like.

Figure 3:
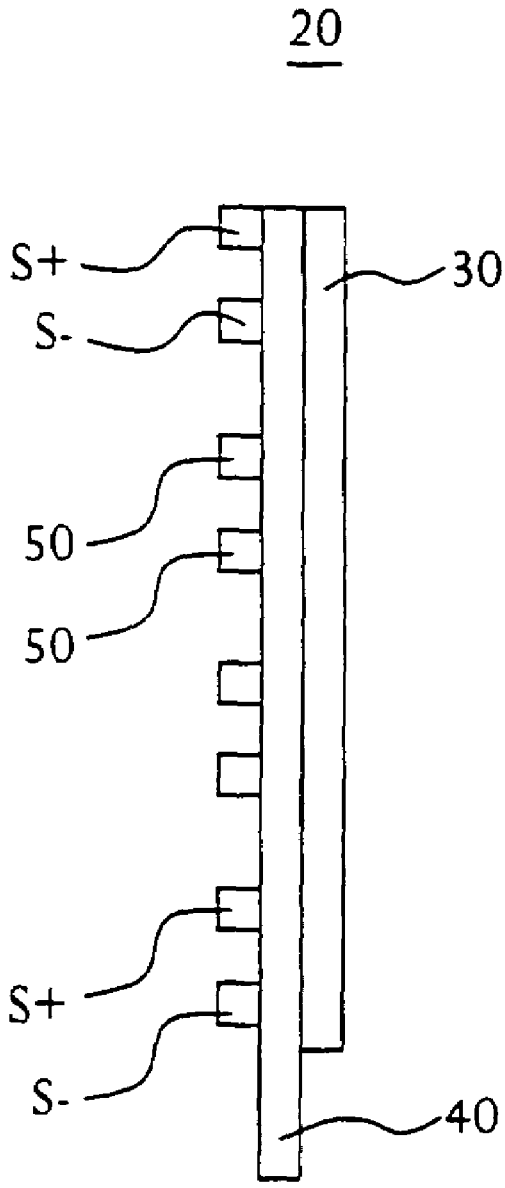
FIG. 3 is a cut-away view of the electrical connector of FIG. 1 taken along line A—A.
Figure 5:
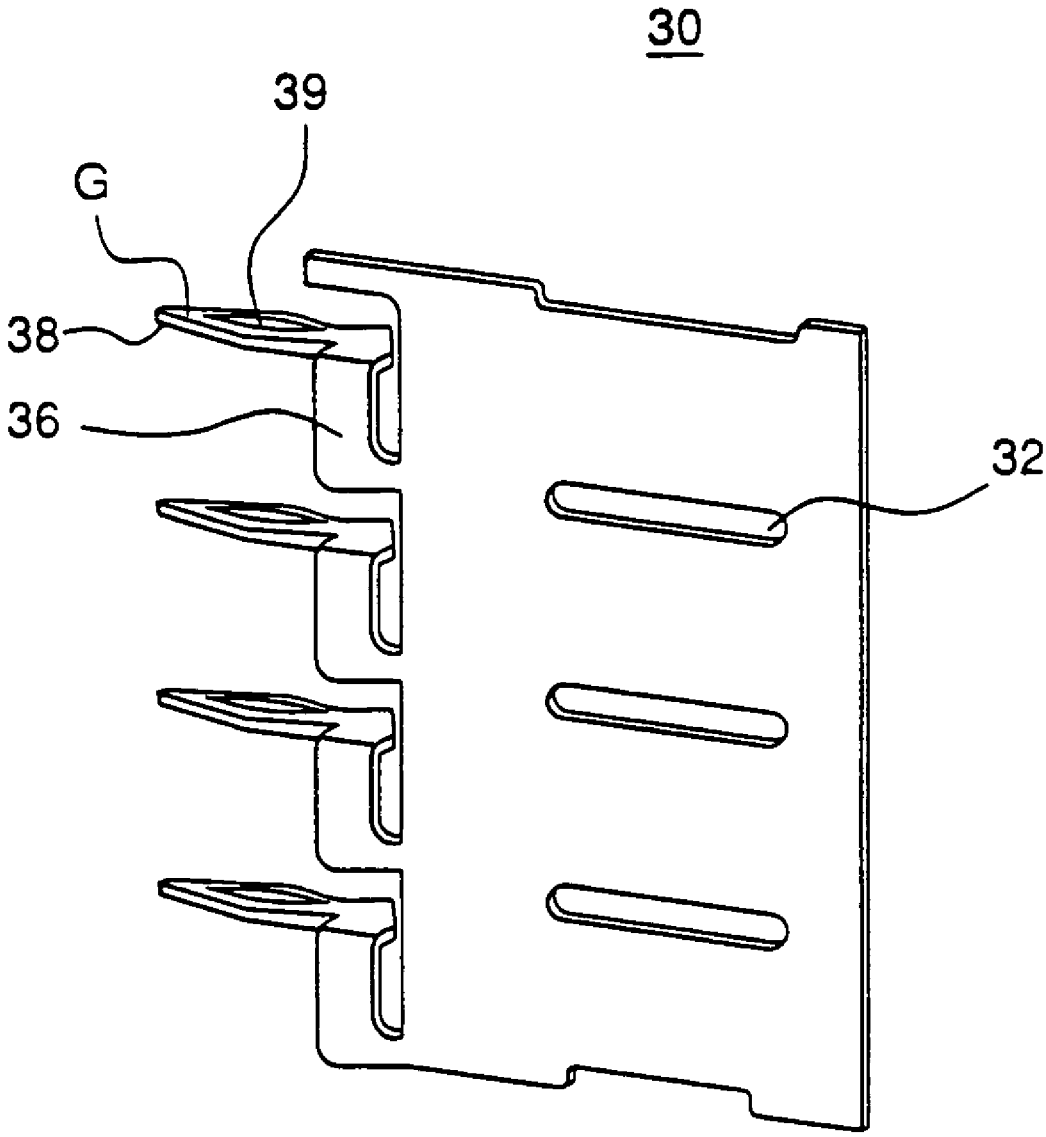
FIG. 5 is a perspective view of an illustrative ground plane of the electrical connector of FIG. 1.

Referring now to FIG. 3, dielectric 40 is disposed between conductors 50 and ground plane 30. FIG. 5 is a perspective view of ground plane 30. As shown in FIG. 5, ground plane 30 is substantially continuous and planar and is disposed on one planar surface of dielectric 40. Ground plane 30 comprises apertures 32, offset sections 36 and ground contact pins 38. Apertures 32 are disposed between differential pairs of conductors 50. The size of apertures 32 may be modified to achieve a desired impedance characteristic. Offset section 36 comprises a substantially planar surface bent at approximately a right angle to offset ground contact pin 38 from the plane of ground plane 30 for connection to receptacle 80. Ground contact pin 38 is shown with an aperture 39 for providing good contact with receptacle 80; however, contact pin 38 may be any suitable contact pin. Ground plane 30 may comprise phosphor bronze, beryllium copper, and the like.

Ground plane 30 and conductors 50 connect to receptacle 80 via ground contact pins 38 and signal contact pins 58, respectively. As such, and as illustrated in FIGS. 6 and 7, ground contact pins 38 and signal contact pins 58 are aligned with receptacle contacts 82.

Figure 6:
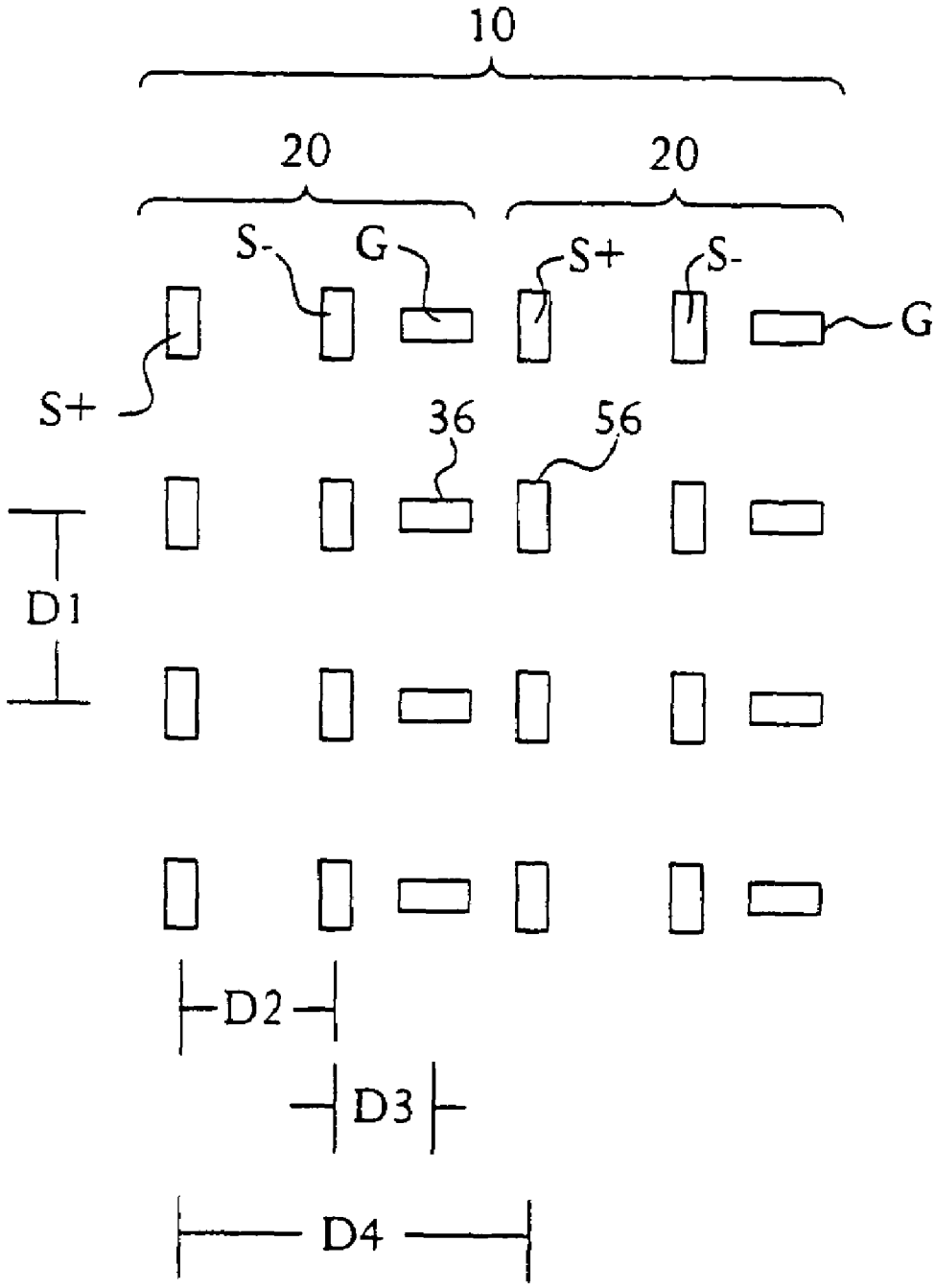
FIG. 6 is a cut-away view of the electrical connector of FIG. 1 taken along Line B—B.

As shown in FIG. 6, signal contact pins 56 and ground contact pins 36 are arranged into a plurality of rows and columns. As can be seen, a row includes a repeating sequence of, from left to right, a positive signal conductor S+, a negative signal conductor S−, and a ground conductor G. Spacing between contact pins within a row may vary. For example, spacing between positive signal conductor S+ and negative signal conductor S− is a distance D2, which may be about 2 mm. Spacing between signal conductors S+, S− and ground conductor G is a distance D3, which may be about 1.25 mm. Spacing between corresponding conductors of an adjacent module 20 is a distance D4, which may be about 4.5 mm. Distance between adjacent columns is a distance D1, which may be about 2.7 mm. A typical pitch is about 2.5 times the width of conductors S; however, the connector can be configured for maximum signal density per linear inch and maximum trace routing channels, depending on the needs of the application.

Figure 7:
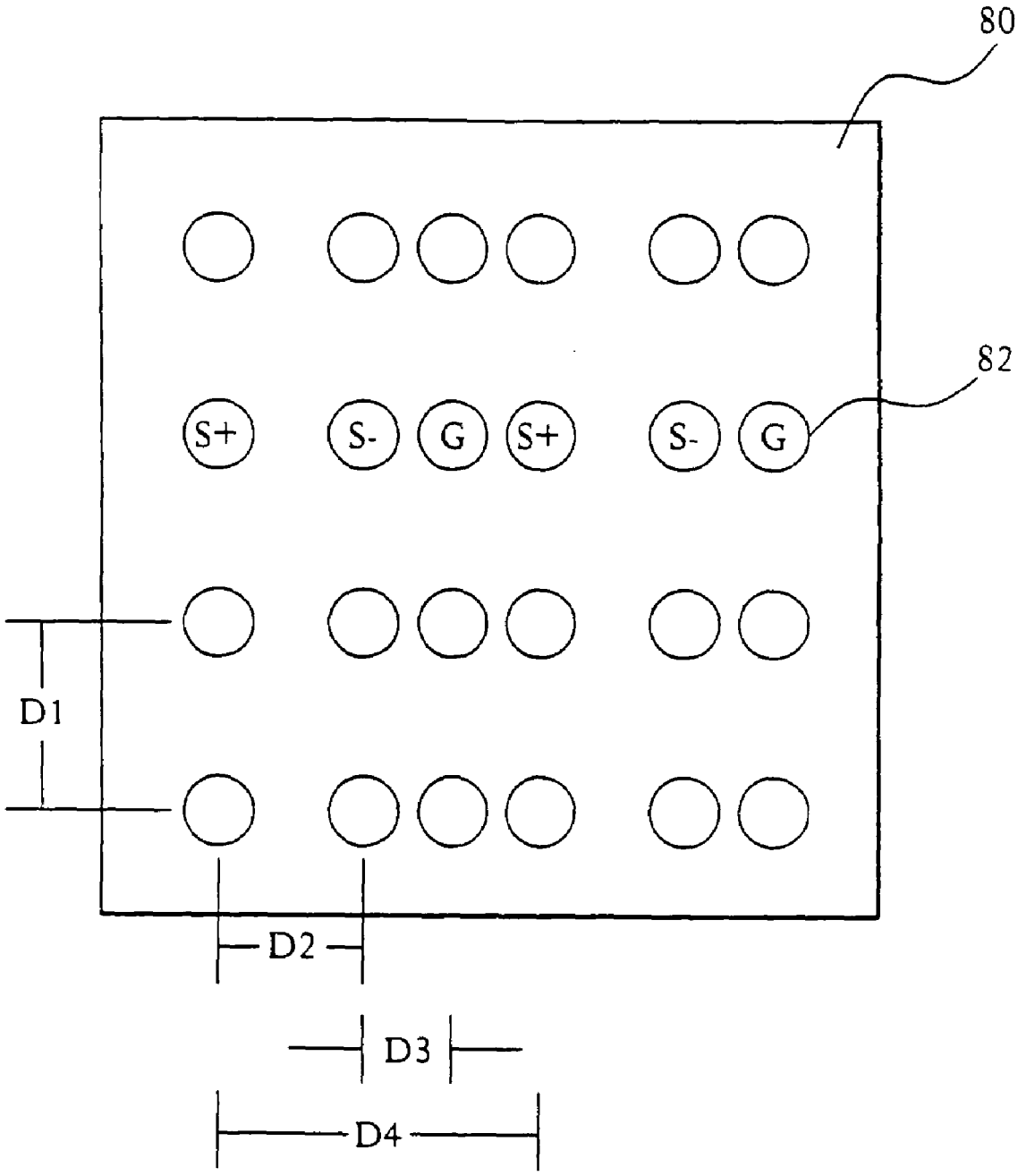
FIG. 7 is a front view of the receptacle of FIG. 1.

As shown in FIG. 7, receptacles 82 are aligned to receive the appropriate signal contact pins 56 and ground contact pins 36. Receptacles 82 are illustrated as having a round cross section; however, it should be noted that the use of other shapes, such as rectangular, square, and the like, is also contemplated.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. A method of making an electrical interconnect system, comprising:

providing a pair of electrical conductors suitable for transmitting differential signals;

providing a ground plane;

positioning a dielectric material between the ground plane and the pair of electrical conductors; and providing a first and a second receptacle contact each comprising a contact beam for engaging a corresponding one of the electrical conductors, an offset adjoining the contact beam, and a pin adjoining the offset, wherein portions of the contact beams of the first and second receptacle contacts are positioned in a common plane, and the offsets extend from the associated contact beams in substantially opposite directions and by substantially equal distances when the contact beams engage the corresponding ones of the electrical conductors whereby the pins of the first and second receptacle contacts are positioned on opposite sides of the common plane.

2. The method of claim 1, wherein providing a first and a second receptacle contact comprises stamping one or more sheets of electrically-conductive material to form a first and a second pre-formed contact, and bending the first and second pre-formed contacts to form the offsets of the first and second receptacle contacts.

3. The method of claim 1, wherein positioning a dielectric material between the ground plane and the pair of electrical conductors comprises etching the pair of electrical conductors onto one surface of the dielectric material.

4. The method of claim 3, wherein positioning a dielectric material between the ground plane and the pair of electrical conductors further comprises etching the ground plane onto another surface of the dielectric.

5. The method of claim 1, further comprising connecting a connector to each end of each of the pair of electrical conductors.

6. The method of claim 5, wherein connecting a connector to each end of each of the pair of electrical conductors comprises connecting a contact pin to one end of each of the pair of electrical conductors and connecting a solder ball to the other end of each of the pair of electrical conductors.

7. The method of claim 1, wherein the contact beam of each of the receptacle contacts comprises a bowed portion and a substantially straight portion.

8. The method of claim 7, wherein the substantially straight portions of the receptacle contacts lie in the common plane.

9. The method of claim 2, wherein bending the first and second pre-formed contacts to form the offsets of the first and second receptacle contacts comprises forming two bends of approximately ninety degrees in each of the first and second pre-formed contacts.

10. A method of making an electrical connector, the electrical connector comprising a pair of electrical contacts, the pair of electrical contacts each comprising a straight section that lies in a common plane, an offset portion connected to the straight section, and a pin connected to the offset portion, comprising the step of:

bending the pair of electrical contacts in equal and opposite directions so that each pin is positioned on opposite sides of the common plane and each pin is evenly spaced from the common plane.

11. The method of claim 1, further comprising the step of bending the electrical contacts so that the offset portion of each one of the pair of electrical contacts is perpendicular to the common plane.

* * * * *